US007658658B2

(12) United States Patent
Zhu

(10) Patent No.: US 7,658,658 B2
(45) Date of Patent: Feb. 9, 2010

(54) ELECTRICAL CONNECTOR WITH DEPRESSIBLE CONTACT STABLY RETAINED

(75) Inventor: Yu Zhu, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/220,196

(22) Filed: Jul. 21, 2008

(65) Prior Publication Data

US 2009/0023346 A1 Jan. 22, 2009

(30) Foreign Application Priority Data

Jul. 19, 2007 (CN) ..... 2007 2 0040894 U

(51) Int. Cl.
*H01R 4/48* (2006.01)

(52) U.S. Cl. ..... 439/862

(58) Field of Classification Search ..... 439/862, 439/733.1, 869, 71, 751
See application file for complete search history.

(56) References Cited

U.S. PATENT DOCUMENTS

| | | | | |
|---|---|---|---|---|
| 5,338,231 | A * | 8/1994 | Wilhite | 439/660 |
| 6,325,641 | B1 * | 12/2001 | Nishiyama et al. | 439/76.2 |
| 6,379,195 | B1 * | 4/2002 | Torikoshi et al. | 439/733.1 |
| 6,454,607 | B2 * | 9/2002 | Bricaud | 439/630 |
| 6,663,445 | B1 * | 12/2003 | Yeh | 439/862 |
| 6,688,893 | B1 * | 2/2004 | Huang et al. | 439/66 |
| 6,758,702 | B2 * | 7/2004 | Johnescu | 439/862 |
| 7,037,113 | B2 * | 5/2006 | Soh | 439/66 |
| 7,048,567 | B2 * | 5/2006 | Regnier et al. | 439/329 |
| 7,278,892 | B1 * | 10/2007 | Chien et al. | 439/862 |
| 7,361,023 | B2 | 4/2008 | Wu | |
| 2001/0023142 | A1 * | 9/2001 | Miwa et al. | 439/79 |
| 2005/0042935 | A1 * | 2/2005 | Larsen | 439/751 |
| 2007/0155229 | A1 * | 7/2007 | Wu | 439/567 |

FOREIGN PATENT DOCUMENTS

| | | | |
|---|---|---|---|
| CN | 201029181 | Y | 2/2008 |
| JP | P2000-331732 | A | 11/2000 |

* cited by examiner

*Primary Examiner*—T C Patel
*Assistant Examiner*—Vladimir Imas
(74) *Attorney, Agent, or Firm*—Wei Te Chung; Andrew C. Cheng; Ming Chieh Chang

(57) ABSTRACT

An electrical connector (1) comprises a dielectric housing (2) and a plurality of conductive contacts (3). The dielectric housing (2) comprises a plurality of contact passages (20) having retaining means (206) therein. Each conductive contact (3) comprises a retaining portion (30) engaging corresponding the contact passage (20) and a resiliently depressible contacting portion (34). When inserting, the conductive contact (3) is respectively inserted in the contact passages (20) along an inserting direction while the retaining portion (30) along a first path, the contacting portion (34) along a second path, but the retaining means (206) is not on the first path and second path and engages the inserted conductive contact (2).

1 Claim, 4 Drawing Sheets

ELECTRICAL CONNECTOR WITH DEPRESSIBLE CONTACT STABLY RETAINED

BACKGROUND OF THE INVENTION

1. Field of the Invention

The present invention is generally related to the art of electrical connector, and more especially, to an electrical connector with depressible contact, the depressible contact is stably retained in the electrical connector.

2. Description of Related Art

An electrical connector generally comprises a dielectric housing and some conductive contacts secured in the dielectric housing, the dielectric housing retain the conductive contacts in certain position. Some modules with conductive contacts secured in a dielectric housing is manufactured by a process called insert molding, however, when the conductive contacts density is low, the insert molding process is not preferred, the conductive contacts is usually insert into a pre-molded dielectric housing.

Some electrical connectors comprise compressible conductive contacts, a typical compressible conductive contact generally defines a plurality of bends to gain a good elasticity, this kind of conductive contact has a good elasticity, so it is easy to be deform. When inserting, a this kind of conductive contact is difficult to align with the contact passage in the dielectric housing due to the deformation, as a result, the yield rate of this kind electrical connector is low. An example of electrical connector with depressible contacts inserted into dielectric housing can be seen in Japanese patent application publication No. 2000-331732 published on Nov. 30, 2000.

Hence, an improved electrical connector is required to overcome the disadvantages of the prior art.

SUMMARY OF THE INVENTION

Accordingly, an object of the present invention is to provide an electrical connector with depressible contact, the depressible contact is stably retained in the electrical connector.

In order to achieve the above-mentioned object, an electrical connector comprises a dielectric housing comprising a plurality of contact passages having retaining means therein, and a plurality of conductive contacts respectively secured in the contact passages. Each the contact passage comprises a pair of opposite lateral walls, the retaining means comprises protrusions respectively protruding from the pair of lateral walls, and the distance between the lateral walls is longer than the distance between the protrusions. Each contact comprises a retaining portion engaging corresponding the contact passage and a resiliently depressible contacting portion partially exposed out of the dielectric housing. The retaining portion and contacting portion of the same conductive contact are in a common plane parallel to the lateral walls. The retaining means engaging the conductive contact on a portion none of the retaining portion and the contacting portion.

Other objects, advantages and novel features of the present invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Referring to FIGS. 1-4, an electrical connector 1 comprises a dielectric housing 2 comprising a plurality of contact passages 20 and a plurality of conductive contacts 3 respectively inserted in the contact passages 20 along a inserting direction (not shown).

Figure 1:
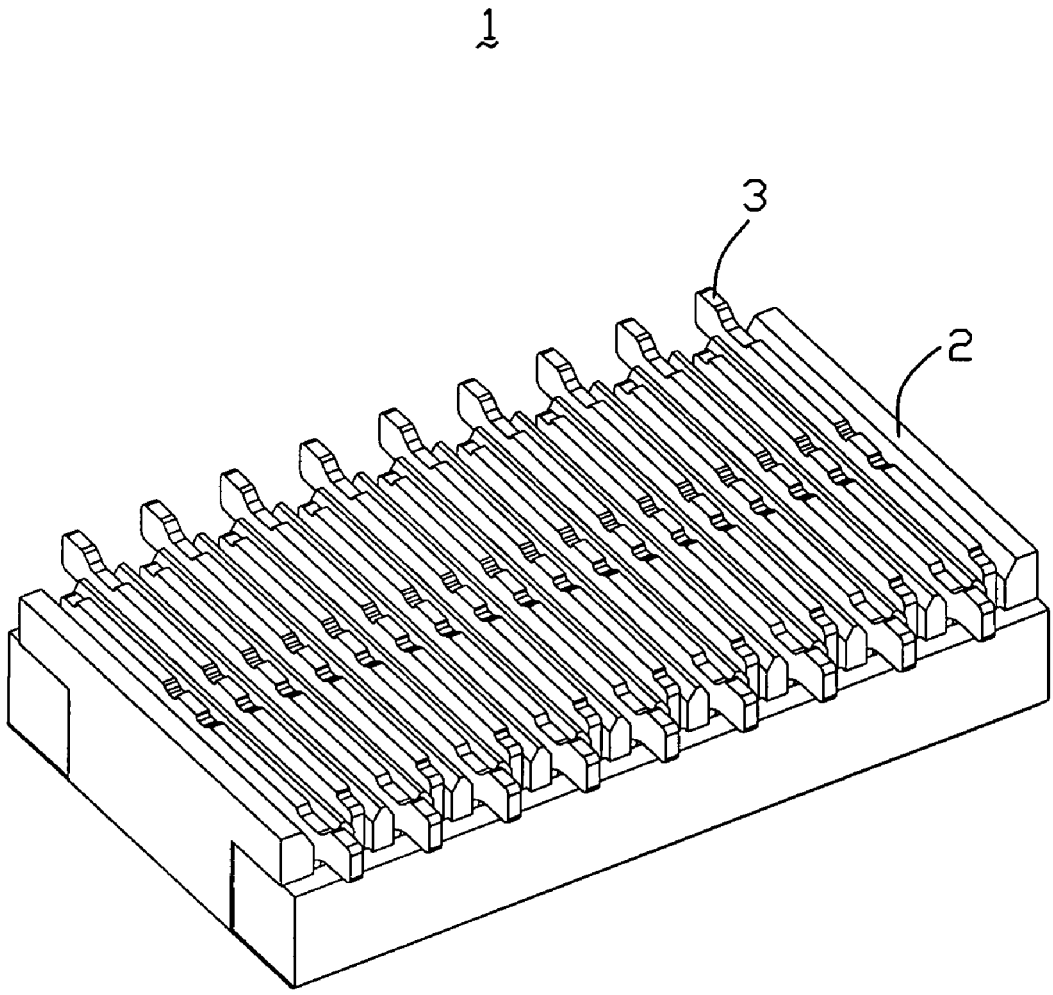
FIG. 1 is an assembled, perspective view of the electrical connector of a preferred embodiment of the present invention.
Figure 2:
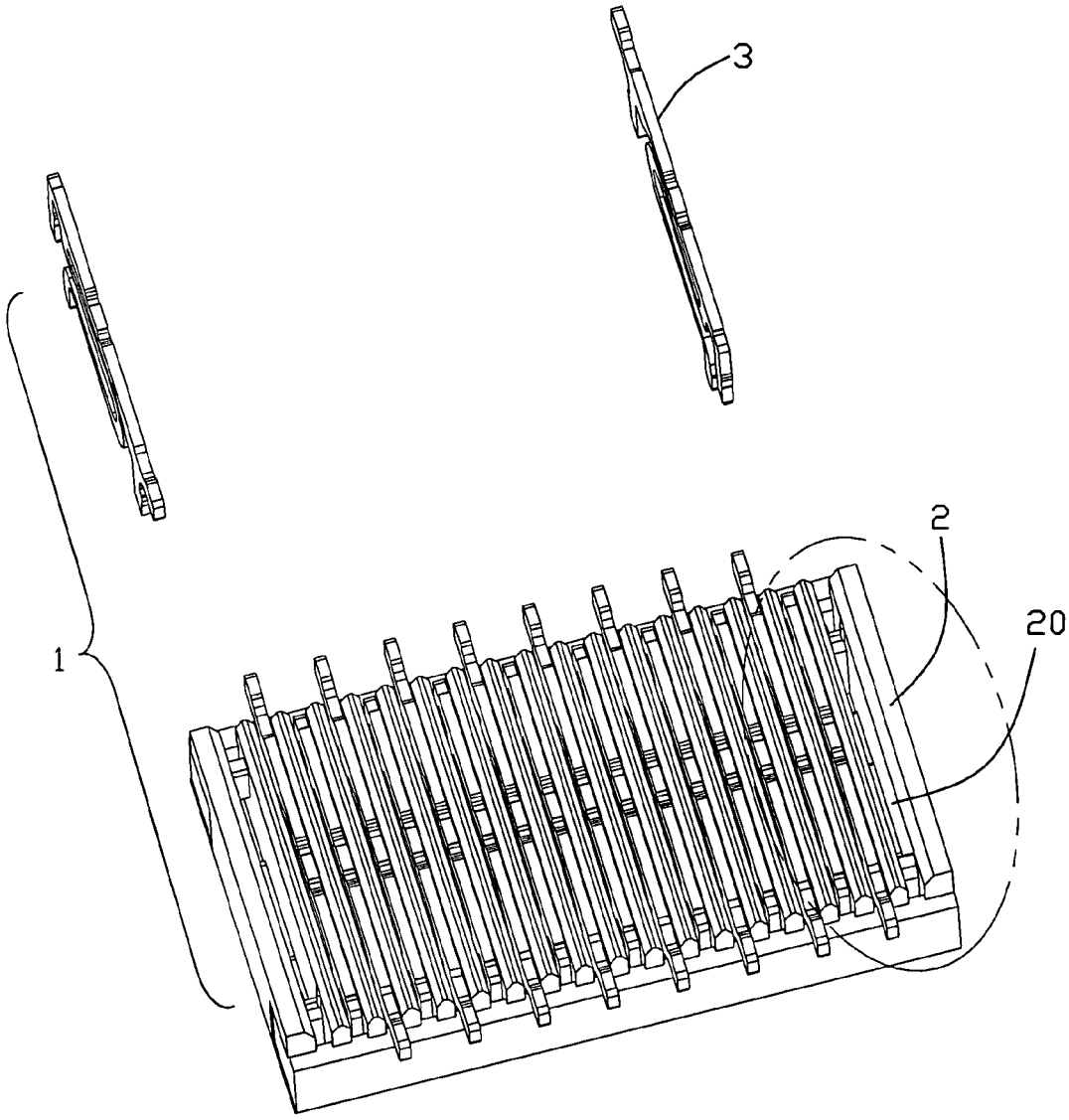
FIG. 2 is a perspective view of the electrical connector as shown in FIG. 1, two conductive contacts is disassembled.
Figure 4:
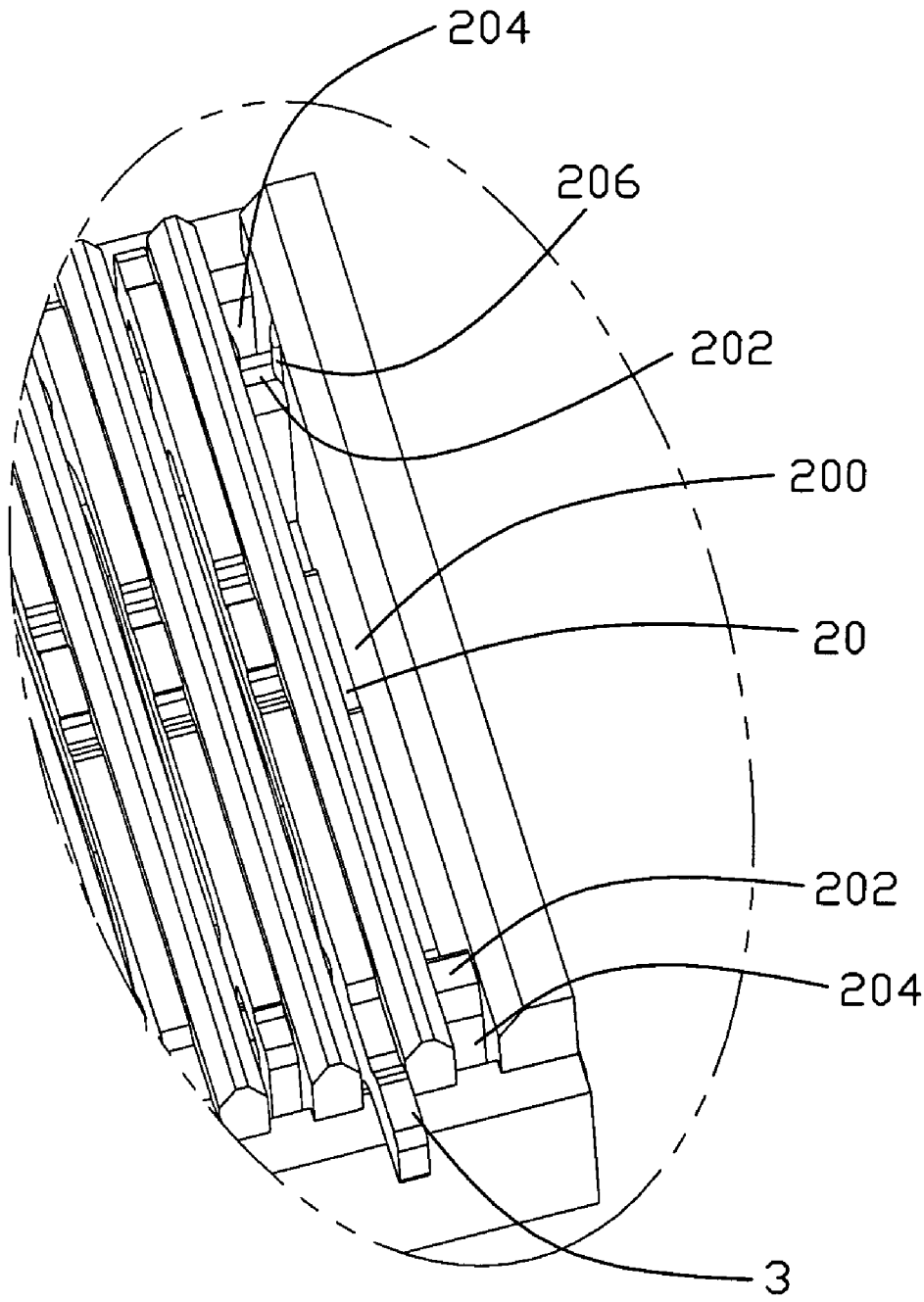
FIG. 4 is a partially enlarged perspective view of the electrical connector as shown in FIG. 2.

Specially referring to FIGS. 2, 4, each contact passage 20 comprises a pair of opposite parallel lateral walls 200, a pair of opposite protrusions 206 respectively protruding from the pair of lateral walls 200, the distance between the lateral walls 200 is longer than the distance between the pair of protrusions 206. The pair of protrusions 206 composes a retaining means 206 suitable for supporting a conductive contact 3 therebetween. Each contact passage 20 further comprises two partitions 202 therein to define two separate retaining passages 204 in each contact passage 20. The retaining means 206 is adjacent to one of the two partitions 202.

Figure 3:
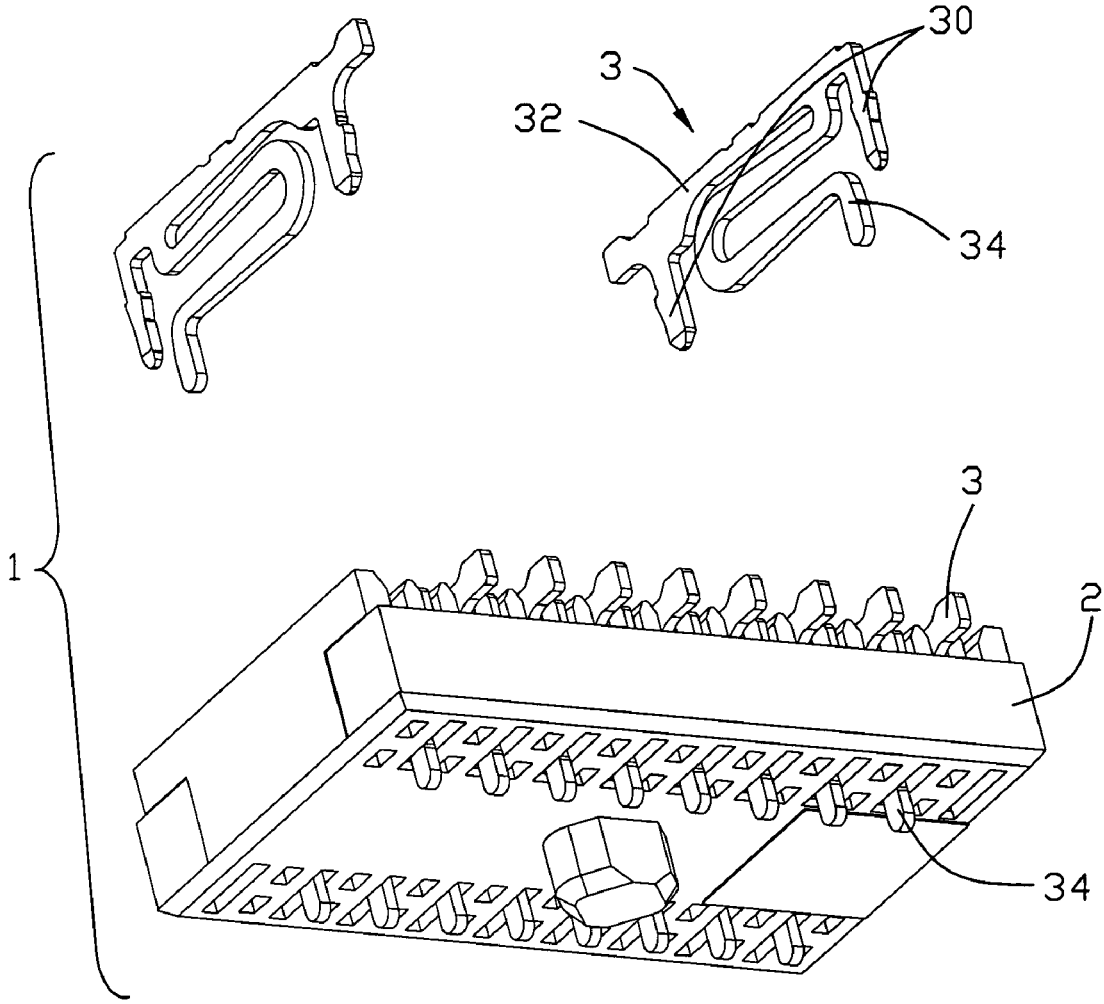
FIG. 3 is a perspective view of the electrical connector as shown in FIG. 2, viewed from another direction.

Specially referring to FIG. 3, each conductive contact 3 is in a common plane parallel to the pair of lateral walls 200 by made out of metal sheet without bend. Each conductive contact 3 comprises a retaining portion 30 comprising two retaining sections 30 defining a space (not labeled) therebetween, a base bar 32 connecting the two retaining sections 30, and a resiliently depressible contacting portion 34 extending from the base bar 32 and comprising at least two curves disposed in the space (not labeled) between the two retaining section 30. The retaining sections 30 of the retaining portion 30 respectively engage the retaining passage 204 and interfere with the partition 202.

When inserting the conductive contact 3 along the inserting direction (not shown), the retaining portion 30 moves along a first path (not shown), the contacting portion 34 moves along a second path (not shown), the retaining means 206 is not on the first path (not shown) and second path (not shown). Since the distance between the lateral walls 200 of the contact passage 20 is longer than the distance between the pair of protrusions 206, there is more space for the conductive contact 3 pass through, in another word, there is a big allowance between the conductive contact 3 and the contact passage 20, so the conductive contact 3 can be easily assembled with the dielectric housing 2 without interference between the contacting portion 34 and the contact passage 20. However, the space between the pair of protrusions 206 of the retaining means is a tiny smaller than the thickness of the conductive contact 3, the two protrusions 206 engage the lateral side of the base bar 32 of the conductive contact 3 preventing the conductive contact 3 from movement in the direction perpendicular to the inserting direction (not shown). For the retaining means 206 is not on the first path (not shown) and second path (not shown), it will not interfere with the retaining portion 30 or the contacting portion 34 of the conductive contact 3, it only engages the base bar 32 at the last time of inserting operation.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulative housing;

a plurality of passageways defined in the housing in parallel relation with one another, each of said passageways including at least a large contacting passage and a small retention passage side by side spaced from each other;

a plurality of contacts essentially extending in a common plane and disposed in the corresponding passageways, respectively, and each of the contacts including a curved resilient contacting section receiving in the corresponding large contacting passage in a relatively free manner and a relatively rigid retention section received in the corresponding small retention passage in a secured manner; wherein each of said passageway is equipped with restriction means which is located between the large contacting passage and the small retention passage so as to sandwich the corresponding contact in a thickness direction of said contact under a condition that both said retention section and said contacting section are not affected by said restriction means during assembling the contact into the corresponding passageway; wherein the restriction means engages a portion of the corresponding contact where the contacting section and the retention section are joined.

* * * * *